United States Patent [19]

Verclyte et al.

[11] Patent Number: 4,957,145

[45] Date of Patent: Sep. 18, 1990

[54] PNEUMATIC WEFT THREAD HOLDER FOR A SELVAGE DEVICE

[75] Inventors: Eddy Verclyte, Ieper; Ignace Meyns, Reninge; Patrick Glorie, Ieper, all of Belgium

[73] Assignee: Picanol N.V., Belgium

[21] Appl. No.: 371,029

[22] Filed: Jun. 26, 1989

[30] Foreign Application Priority Data

Jun. 29, 1988 [BE] Belgium ..... 8800746

[51] Int. Cl.[5] ..... D03D 47/38; D03D 47/48

[52] U.S. Cl. ..... 139/434

[58] Field of Search ..... 139/434, 194

[56] References Cited

U.S. PATENT DOCUMENTS 3,845,790 11/1974 Filter et al. ..... 139/194
4,552,187 11/1985 Bertsch et al. ..... 139/434
4,565,225 1/1986 Bertsch ..... 139/434

FOREIGN PATENT DOCUMENTS 2057971 3/1987 Japan ..... 139/434
1365903 9/1974 United Kingdom .

*Primary Examiner*—Andrew M. Falik
*Attorney, Agent, or Firm*—Bacon & Thomas

[57] ABSTRACT

A pneumatic thread holder for a selvedge device on weaving machines includes a blower nozzle, a support for the weft thread located underneath the nozzle, and an opening for the weft thread in line with the blower nozzle. The opening is enlarged transverse to the blowing direction of the blower nozzle in order to prevent air current reflections or deviations from occurring when the tucking needle passes beneath the opening, thus ensuring that the end of the weft thread remains held in a correct position by the pneumatic holder.

2 Claims, 2 Drawing Sheets

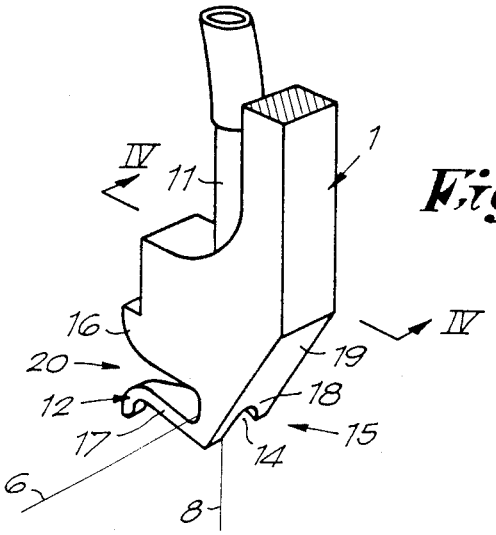
Fig. 3
Fig. 4
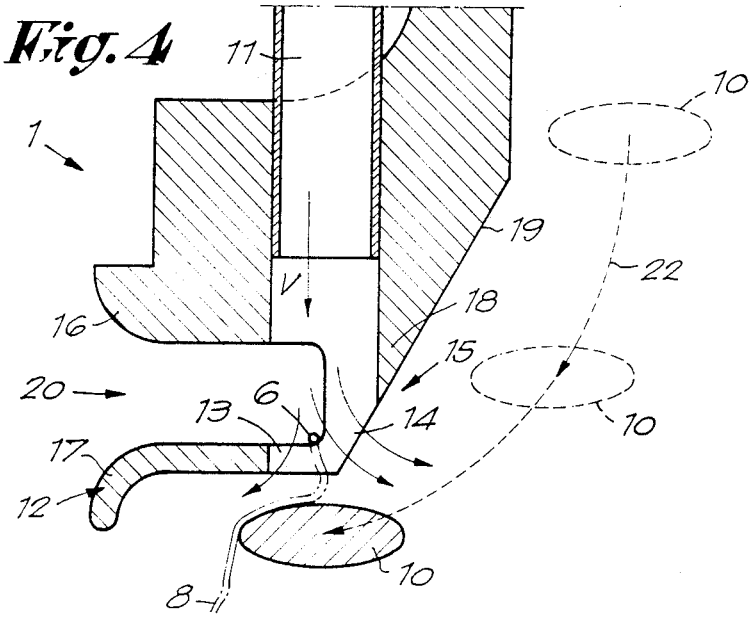
Fig. 5
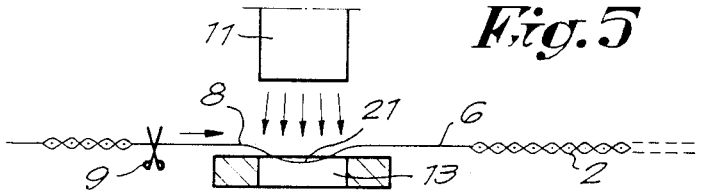

PNEUMATIC WEFT THREAD HOLDER FOR A SELVAGE DEVICE

BACKGROUND OF THE INVENTION

This invention concerns a pneumatic thread holder for a selvedge device on weaving machines.

It is known that cloths with selvedges can be made by successively weaving in the free ends of the weft threads between leno threads, holding these weft threads between the edge of the cloth and the leno threads by means of a thread holder, cutting the weft threads at the same place each time between the thread holder and leno threads, and finally drawing back the free weft thread ends by means of a tucker needle and tucking them into the next shed. Such a known device always uses either mechanical or pneumatic means to hold the weft thread close to the cloth and/or to tuck the weft thread end into the next shed.

In the case of thread holders in which the thread, before it is cut to length, is held by means of an air current, it has been observed that the passage of some object, for instance a tucking needle, in front of the pneumatic holder causes disturbances in the air current which is meant to hold the weft thread, so that the thread does not remain in the correct place necessary to transfer it to the actual insertion device, for example the tucking needle. At the moment that an object passes in front of the pneumatic thread holder so that it comes into the air current, air current reflections and/or deviations and/or eddies are produced, as a result of which the weft thread can wander and even come free of the pneumatic holder, which always results in a fault in the selvedge.

SUMMARY OF THE INVENTION

The present invention has as its object a pneumatic thread holder which has the advantages of a mechanical thread clip, namely that it holds the weft thread positively, and the advantages of a pneumatic thread holder, namely, lower inertia, less mechanical wear due to fewer moving parts, less risk of fouling, etc.

To this end, the pneumatic thread holder according to the invention consists a blower nozzle and a support for the weft thread placed underneath the blower nozzle. An opening for the weft thread is placed in line with the blower nozzle and includes an enlargement transverse to the direction of air blown from the blower nozzle.

BRIEF DESCRIPTION OF THE DRAWINGS

In order to better explain the characteristics of the invention, the following preferred embodiment is described, by way of example only and without being limitative in any way, with reference to the accompanying drawings, where:

FIG. 3 is a view in the direction of arrow F3 in FIG. 2;

FIG. 4 is a cross-section along line IV—IV in FIG. 3;

FIG. 5 illustrates schematically a disadvanatage which can arise if the above-mentioned opening is not provided with the above-mentioned enlargement.

DETAILED DESCRIPTION OF THE PREFERRED EMBODIMENT

Figure 1:
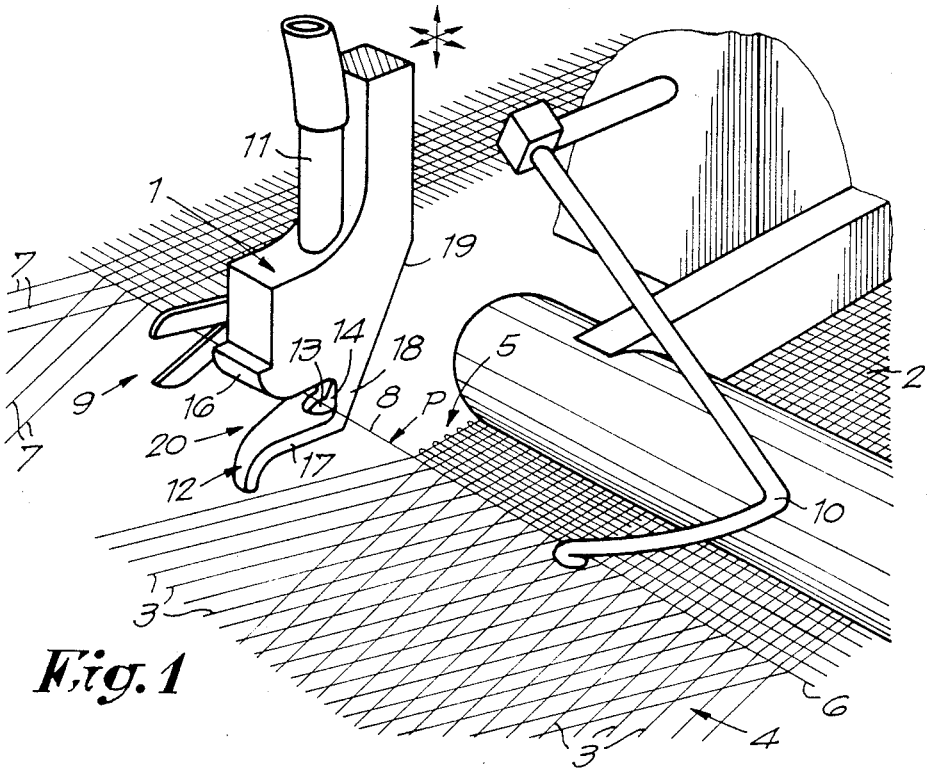
FIG. 1 is a perspective view of a thread holder according to the invention in the weaving machine.

FIG. 1 shows a thread holder 1 according to the invention. To illustrate the use of such a thread holder and its place in the weaving machine, the cloth 2, the warp threads 3, the shed 4, the cloth edge 5, the last weft thread inserted 6, the leno threads 7 which hold the weft thread 6 by its end 8, the cutter 9 and the tucking or tucker needle 10 are also shown.

Figure 2:
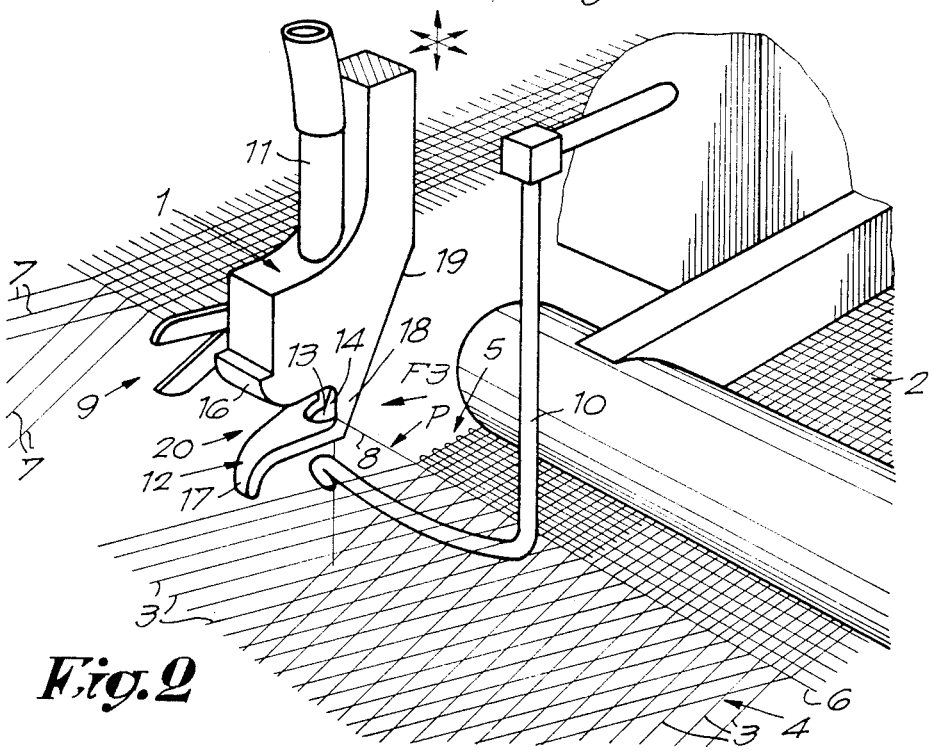
FIG. 2 shows a similar view to that shown in FIG. 1, but for a different position.

The method used to form a selvedge on a cloth edge 5 is common technology and consists in that successively: the weft thread 6 is inserted into the shed 4, such that the free end 8 of weft thread 6 extends between the leno threads 7; the weft thread 6 is woven in by means of the warp threads 3 and the leno threads 7; a thread holder 1 holds the weft thread 6 between the cloth edge 5 and the leno threads 7; the weft thread 6 is cut free from the leno threads 7 by the cutter 9, and the tucker needle 10 reaches between the upper warp threads 3 into the shed 4 in order to draw in the cut end 8 into the shed 4 so that it is woven in together with the next weft thread. FIGS. 1 and 2 show the positions respectively before and after cutting the thread end 8.

While the cut end 8 is being held by the tucker needle 10 the thread holder 1 describes a motion around the tucker needle 10, so that the end 8 comes into the hook-shaped part of the tucker needle 10. Because such a motion is also used with a mechanical thread clip, this will not be further explained.

The pneumatic thread holder 1 according to the invention, as shown in FIGS. 1 to 4, includes a blower nozzle 11 and, at a short distance below blower nozzle 11, a support 12 in which there is an opening 13 in line with the blower nozzle 11. Opening 13 has an enlargement 14 transverse to the blowing direction V of the blower nozzle 11.

The pneumatic thread holder 1 preferably includes a U-shaped body 15 whose arms 16 and 17 extend horizontally and in which there is a bore through the arms 16 and 17, so that the bore in the upper arm 16 forms the above-mentioned blower nozzle 11 and the bore in the lower arm 17 forms the above-mentioned opening 13.

The transverse enlargement 14 extends through the rear wall 18 of the U-shaped body 15. This enlargement 14 is preferably obtained by the U-shaped body 15, more particularly its rear wall 18, having a bevel 19 which intersects the opening 13.

The pneumatic thread holder according to the invention is presented to the weft thread 6 such that the end 8 of the weft thread 6 comes to lie in the recess 20 of the U-shaped body 15. After the end 8 is cut free by the cutter 9, it is blown into the opening 13 and in this way is held pneumatically until it is gripped by the tucker needle 10 at the point P.

The presence of the above-mentioned enlargement 14 is extremely important for correct operation of the pneumatic thread clip. When the end 8 is transferred to the tucker needle 10, both the thread holder 1 and the tucker needle 10 describe a motion in which the tucker needle 10 passes partly under the U-shaped body 15. If there were no enlargement 14, this would result in the airflow through the opening 13 being impeded, causing eddies and reflections to occur which could cause the end 8 located in the opening 13 to inadvertently come out of the opening 13 or be displaced with respect to the rear wall 18 so that the needle 10 could not grip end 8.

As a result of the presence of the transverse enlargement 14, when however, the tucker needle 10 passes underneath the opening 13 the air can escape to the side either wholly or partly, as shown in FIG. 4, such that the end 8 of the weft thread 6 remains held in the correct position.

Here it should be noted that if the enlargement 14 were not present, the airflow through the blower nozzle 11 could be increased in an attempt to maintain enough holding force. Such an increase would only increase the effect just described. Moreover, the blower nozzle 11 could not operate continuously, since in such a case in the condition shown in FIG. 1 a situation as shown in FIG. 5 would arise, such that the end 8 would cause a sag 21 in the opening 13, different for each weft thread, with the result that all thread ends 8 to be tucked in would not be cut at the same point, resulting in an irregular selvedge.

The opening 14 therefore offers the additional advantage that it makes possible trouble-free operation with a relatively low airflow.

The bevel 19 also enables the relative motion 22 of the thread holder 1 and the tucker needle 10 to be very flexible, since the needle 10 has more freedom of movement and can remain closer to the thread holder 1, as shown schematically in FIG. 4.

The present invention is not limited to the embodiment described by way of example and shown in the accompanying drawings; on the contrary, such a pneumatic thread holder can be made in different forms and dimensions while still remaining within the scope of the invention.

We claim:

1. A pneumatic weft holder for a weaving machine selvedge device including a tucking needle which passes on one side of said holder during a selvedge forming operation, comprising a blower nozzle; means on a side of said nozzle located in a blowing direction of said blower nozzle for supporting said weft thread, said support means being located between said blower nozzle and said one side of the holder passed by the tucking needle; and an opening in the support means which is in line with the blowing direction of said blower nozzle, wherein said opening has means including an enlargement transverse to the blowing direction of the blower nozzle for permitting air to escape when said tucking needle passes on said one side of the holder, thereby preventing air current fluctuations caused by said needle from disturbing the position of said thread.

2. A pneumatic thread holder as claimed in claim 1, further comprising a U-shaped body having arms which extend transverse to said blowing direction, a wall connecting said arms, and a bore through said arms forming the blower nozzle and the opening respectively, said wall of said U-shaped body including a bevel which intersects the opening, said bevel forming one wall of said opening and consequently said enlargement.

* * * * *